US007552800B2

(12) United States Patent
Puskala et al.

(10) Patent No.: US 7,552,800 B2
(45) Date of Patent: Jun. 30, 2009

(54) METHOD AND CALL SYSTEM FOR REMOTELY COMMUNICATING WITH AN ELEVATOR IN PREDICTION OF A PASSENGER

(75) Inventors: Aapo Puskala, Helsinki (FI); Pekka Korhonen, Espoo (FI); Niko Rusanen, Helsinki (FI); Rauno Hatakka, Riihimäki (FR)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 12/035,367

(22) Filed: Feb. 21, 2008

(65) Prior Publication Data

US 2008/0217112 A1 Sep. 11, 2008

Related U.S. Application Data

(63) Continuation of application No. PCT/FI2006/000280, filed on Aug. 17, 2006.

(30) Foreign Application Priority Data

Aug. 31, 2005 (FI) ..... 20050867

(51) Int. Cl.
*B66B 1/20* (2006.01)

(52) U.S. Cl. ..... 187/384; 187/392

(58) Field of Classification Search ..... 187/380–388, 187/391–393
See application file for complete search history.

(56) References Cited

U.S. PATENT DOCUMENTS

| | | | | |
|---|---|---|---|---|
| 4,520,905 | A * | 6/1985 | Sasao | 187/380 |
| 4,685,538 | A | 8/1987 | Kamaike | |
| 4,979,594 | A | 12/1990 | Begle et al. | |
| 5,984,051 | A | 11/1999 | Morgan et al. | |
| 6,109,396 | A | 8/2000 | Sirag et al. | |
| 6,202,799 | B1 * | 3/2001 | Drop | 187/388 |
| 6,397,976 | B1 | 6/2002 | Hale et al. | |

FOREIGN PATENT DOCUMENTS

| | | | |
|---|---|---|---|
| EP | 0 341 381 | A1 | 11/1989 |
| EP | 0 968 953 | A1 | 1/2000 |
| FR | 2 744 435 | A1 | 8/1987 |
| FR | 2 785 597 | A1 | 5/2000 |
| JP | 2005-178927 | A | 7/2005 |
| WO | WO-00/75062 | A1 | 12/2000 |
| WO | WO-01/02279 | A1 | 1/2001 |
| WO | WO-01/25128 | A1 | 4/2001 |

* cited by examiner

*Primary Examiner*—Jonathan Salata
(74) *Attorney, Agent, or Firm*—Birch, Stewart, Kolasch & Birch, LLP

(57) ABSTRACT

A method and call system for an elevator car located within a building that may react to a passenger's approach and arrival in front of the actual elevator door. The system makes use of a sensor located near to an exterior door of the building containing the elevator, and a second different sensor located near to the actual elevator bank in which the arriving passenger would intend to enter. The system may also make use of identifying a passenger based upon a predetermined identification or authorization to include automatic communication through to the elevator for initial entrance floor location as well as an exit floor location based upon the predetermined passenger's identification and/or authorization.

12 Claims, 2 Drawing Sheets

Figure 1:
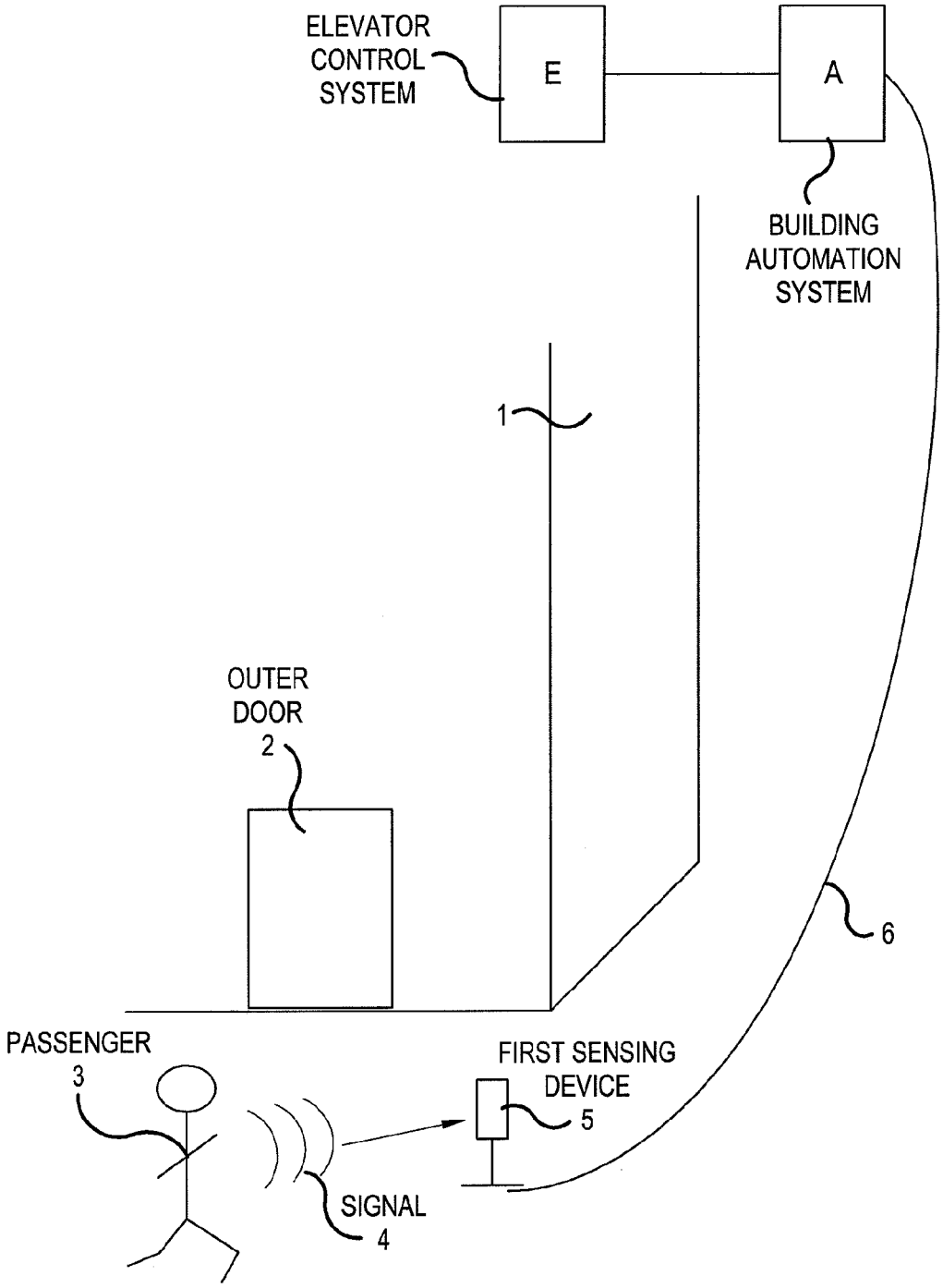

METHOD AND CALL SYSTEM FOR REMOTELY COMMUNICATING WITH AN ELEVATOR IN PREDICTION OF A PASSENGER

This application is a Continuation of co-pending PCT International Application No. PCT/F12006/000280 filed on Aug. 17, 2006, which designated the United States, and on which priority is claimed under 35 U.S.C. § 120. This application also claims priority under 35 U.S.C. § 119(a) on Patent Application No(s). 20050867 filed in Finland on Aug. 31, 2005. The entire contents of each of the above documents is hereby incorporated by reference.

The present invention relates to a method as defined in the preamble of claim 1 and to a call system as defined in the preamble of claim 8 for calling an elevator in a building.

One of the objectives in elevator development work is to achieve efficient and economical utilization of building space. In recent years, this development work has produced various elevator solutions. Good examples of solutions improving economic efficiency and user friendliness have been presented in several patent specifications. In these basically good elevator solutions, however, the elevator passenger often finds it troublesome and inconvenient having to wait around for an elevator in a building. An elevator may e.g. start moving just as a passenger is about to board it, and, on the other hand, the user may have to wait longer than is necessary. The way of entering calls in the elevator system is often found to be inconvenient, and problems and difficulties are also experienced in opening the outer door and/or other doors with keys. Especially old people and persons using a wheelchair may encounter trouble in opening the outer doors of a building, which in many cases are quite heavy, and entering elevator calls in order to reach their destination in the building. Likewise, persons carrying heavy loads with them often find it arduous to open doors and enter elevator calls if the opening of doors and the entry of elevator calls are not automated.

The object of the invention is to provide a solution to the above-mentioned problems or to achieve at least one of the following goals. On the one hand, the invention aims at an improvement allowing an elevator passenger to move about more easily in a building, particularly in a situation where the passenger is entering the building. This means raising the level of passenger service especially during quiet elevator traffic conditions. On the other hand, the invention aims at improving personal passenger service in a building and to add to the value of the building.

The method of the invention is characterized by what is presented in the characterization part of claim 1. The call system of the invention is characterized by what is presented in the characterization part of claim 8. Other embodiments of the invention are characterized by what is disclosed in the other claims. Inventive embodiments are also presented in the description part and drawings of the present application. The inventive content disclosed in the application can also be defined in other ways than is done in the claims below. The inventive content may also consist of several separate inventions, especially if the invention is considered in the light of explicit or implicit sub-tasks or in respect of advantages or sets of advantages achieved. In this case, some of the attributes contained in the claims below may be superfluous from the point of view of separate inventive concepts. Within the framework of the basic concept of the invention, features of different embodiments of the invention can be applied in conjunction with other embodiments.

By applying the invention, one or more of the following advantages can be achieved, among others:

- Convenience of use of the elevator from the elevator passenger's point of view is considerably improved
- An access control system of the building, control of automatic doors and/or the elevator control system as well as other systems related to automation of the building can be easily integrated in the same system
- Convenience of use of the building is improved and those visiting the building can enjoy better elevator service in the building
- The invention can be applied in the case of both larger elevator group and smaller elevator systems, such as e.g. elevator systems of one and/or two elevators
- The invention is thus applicable for use in conjunction with almost any elevators in buildings, preferably stairwell elevators in residential buildings, and/or in small office buildings.

The primary area of application of the invention is in elevators intended for the transport of passengers and/or goods. The invention can be advantageously applied both in elevator groups and in smaller elevator systems, such as e.g. systems of one or two elevators in residential buildings and offices or in other corresponding buildings.

In the method of the invention for calling an elevator in a building to the starting floor of a passenger, the arrival of the passenger is detected by means of a first remote sensing device placed at a first distance from the elevator. Based on this detection, an elevator call is generated to serve the passenger detected by the remote sensing device. The call generated by the first remote sensing device is confirmed on the basis of a detection made by a second remote sensing device provided in the system and located at a second distance from the elevator, the said second distance being shorter than the said first distance. It is additionally possible to use a configuration whereby the call generated by the first remote sensing device will be cancelled unless it is confirmed by the second remote sensing device within a set period of time. After confirmation of the call, it is possible that, based on the identification, a destination call to the destination floor is automatically input to the elevator control system.

Also disclosed as an inventive concept is a method in which a passenger wanting to reach the building or a given space in the building is detected and identified by a first sensing device, as a result of which detection and identification the door of the building is opened and an elevator is called to the passenger's starting floor. The passenger has a predetermined amount of time to board the elevator, which opens the elevator doors on arrival at the passenger's starting floor and remains awaiting the passenger's arrival in the elevator car. The passenger's arrival in the elevator car is detected by a second sensing device placed in the elevator car, which device may be e.g. a photoelectric trip device mounted in conjunction with the elevator door, a sensing device based on RFID, BlueTooth, WiMax or WLAN technology or some other applicable detection method for detecting the passenger's arrival in the elevator car.

The distances do not necessarily mean the actual distance of the sensing devices from the elevator or from the front of the elevator/elevators. Instead, they may be understood as distances between the areas monitored by the sensing devices, or even as typical transition times of an arriving passenger from the areas monitored by the sensing devices to the elevator.

In a method according to the invention, the passenger is detected and identified at least by a first remote sensing device, which detection and identification result in an elevator being called to the passenger's starting floor. After the elevator call has been confirmed, the passenger has a predetermined amount of time to board the elevator. After the confirmation of the call, the elevator doors can be opened if necessary in a delayed manner after the lapse of a predetermined amount of time or upon triggering by the confirmation of the call.

A call system for calling an elevator to a passenger's starting floor according to the invention comprises at least a first remote sensing device placed at a first distance from the elevator for detecting the arriving passenger. In addition, the system comprises a set of equipment for generating a call for an elevator to serve the passenger detected by the remote sensing device. The system comprises at least a second remote sensing device placed at a distance shorter than the first distance from the elevator for confirming the call generated by the first remote sensing device.

In addition, the system may comprise an access control apparatus at least in conjunction with the first remote sensing device, said access control apparatus serving to identify the passenger and the access rights allocated to the passenger in the building. The system may additionally comprise equipment for the input of destination calls for an elevator. It is also possible to implement automatic generation of a passenger's destination call to the elevator control system on the basis of passenger identification. The outer doors and/or other predetermined doors of the building can be opened automatically if necessary on the basis of the detection and/or identification of a passenger.

In the building, the system responsible for opening doors and calling an elevator/elevators may consist of separate subsystems functioning and communicating with each other in a coordinated manner, or a given system, e.g. the control system of the elevator/elevators, controls the other systems to cause them function so as to achieve the objectives.

Figure 2:
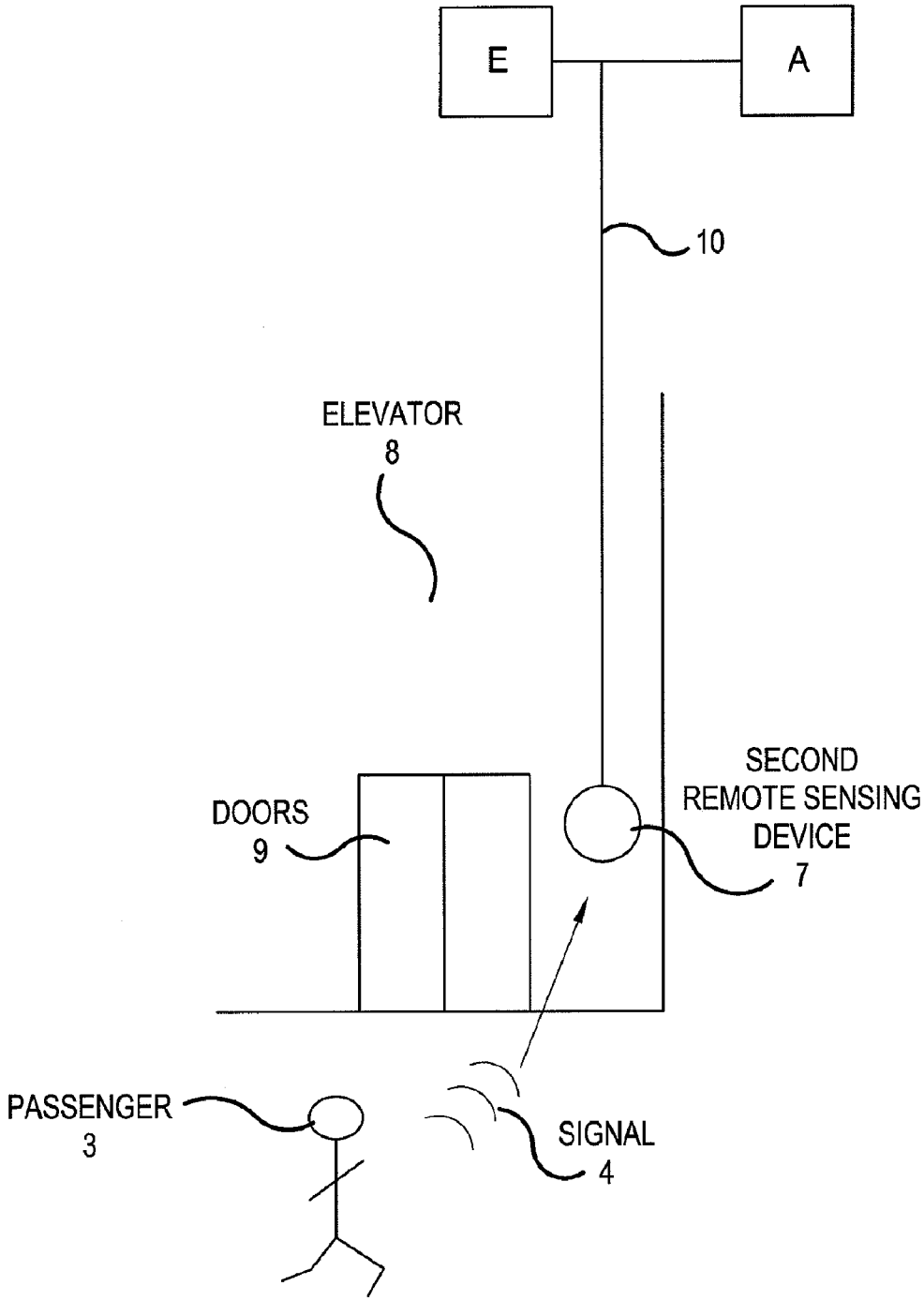

In the following, the invention will be described in detail by referring to a few embodiment examples and the attached drawings, wherein FIG. 1 is a diagrammatic representation of a system according to the invention in a situation where a passenger is arriving in a building FIG. 2 is a diagrammatic representation of a system according to the invention in a situation where a passenger is approaching an elevator.

FIG. 1 represents the arrival of a passenger 3 in a building 1. The passenger 3 approaching the outer door 2 of the building 1 is detected by means of a first remote sensing device 5 on the basis of a signal 4. The first remote sensing device 5 is placed at a first distance from the elevator, in the case of FIG. 1 before the outer door of the building, but it may be located at any appropriate position in or outside the building. Information regarding the arrival of the passenger 3 is transmitted e.g. via a building automation system A to the elevator control system E, to which a call is produced to serve the passenger 3 approaching the elevator. A passenger approaching the building can be detected by the remote sensing device 5 and/or the arriving passenger can be identified. In this case, the elevator call entry system also comprises an access control system fitted as part of it. Different access rights in the building may have been defined for different passengers. The access control system may also be fitted as part of the building automation system A. In the case of FIG. 1, the building automation system transmits information regarding the arrival of the passenger 3 in the building to the elevator control system E, which generates a call to an elevator to bring the elevator to the passenger's floor of arrival. The passenger's floor of arrival may be almost any floor in the building. The floor of arrival may also be a garage or parking hall. A preliminary call can be sent to the elevator even on the basis of the arrival of a car in the parking place. The opening of automatic doors of the building may also be fitted as part of the building automation system A and/or in conjunction with the remote sensing devices. In the system of the invention, the elevator call additionally has to be confirmed to ensure that the elevator will not wait unnecessarily for the passenger at the passenger's arrival floor and be unnecessarily reserved for the passenger detected. The detection of the passenger by means of a remote sensing device may be implemented by applying e.g. RFID, BlueTooth, WiMax and WLAN technologies or by utilizing some other technology applicable for the purpose. As a second remote sensing device, it is also possible to use optical and/or electric sensors, e.g. photocells and/or radars or other appropriate sensing devices indicating the arrival of a passenger in the vicinity of the elevator, in solutions where individual passengers are not to be sensed (identified) in the vicinity of the elevator.

FIG. 2 is a diagrammatic visualization of a situation where a passenger is approaching an elevator in a building. Placed in the vicinity of the elevator is a second remote sensing device 7 for detecting a passenger, this second remote sensing device 7 being located closer to the elevator than the first remote sensing device 5. After this remote sensing device 7 has detected the passenger 3, the elevator call produced by the first remote sensing device 5 is confirmed. Having detected and/or identified the passenger, the remote sensing device 7 transmits corresponding information to the elevator control system E and/or to the building automation system A for confirmation of the call. At this time the elevator may be waiting behind closed doors or it may be coming the starting floor. When the elevator is already at the landing, the opening of the doors can be delayed e.g. so that they are opened upon the lapse of a predetermined amount of time from the confirmation of the initial call and/or after the second remote sensing device 7 has detected the passenger 3. In a preferred case, in the building automation system A and/or in the elevator control system E is defined a given delay during which the elevator call generated by the first remote sensing device is valid. If no confirmation of the call is obtained in the system within this given length of timer then the call is cancelled and the elevator will serve other elevator calls in the normal manner. There may also be fitted in the elevator control system a destination control system known in itself, to which the call entry system of the invention can preferably input calls automatically and on a passenger-specific basis. The elevator control system (E) may also be so implemented that, when it detects another passenger in an elevator car still standing at the arriving passenger's 3 starting floor, the elevator is delayed by a predetermined amount of time to serve the passenger 3 detected by the first or second remote sensing device 5, 7. The doors and/or barriers of the parking garage of the building can also be arranged to be opened automatically on the basis of detection and/or identification of a passenger.

The operation of the system and method of the invention may be e.g. as follows:

The user comes to the door 2 of the building. He/she is detected automatically by a remote sensing device 5. Alternative technologies for this are e.g. RFID, BlueTooth, WiMax and WLAN. If the user is identified and he/she has an access right, then the door is opened automatically.

As the outer door opens, an elevator call is sent and a call acknowledgement light is lit. However, the call is only transmitted if the detection and identification of the passenger take place before the door opens. This is to avoid generating an elevator call in a situation where a resident is leaving the building.

When the elevator 8 arrives at the lobby floor, it keeps the doors 9 closed and waits until the user arrives in front of the elevator door. In front of the door, the user is identified by a second remote sensing device 7 of the same type as at the of the outer door 2. After the user has been identified, the elevator opens the doors automatically. If the user does not arrive to the elevator e.g. within a predetermined amount of time, such as e.g. 10 seconds, after the outer door was opened, then the automatic call is cancelled. Once the user has been identified in the car, the system generates an automatic destination call to the user's floor of residence.

While waiting for a passenger 3 arriving from the outer door 2, the reserved elevator does not serve other landing or car calls until the user identified at the outer door has boarded the elevator or 10 seconds have elapsed after the user was identified at the outer door. Calls entered during this time are registered and stored, but they are only served after this call with a delay.

It is obvious to a person skilled in the art that different embodiments of the invention are not exclusively limited to the examples described above, but that they may be varied within the scope of the claims presented below. It is obvious to a person skilled in the art that the building may contain several different remote sensing devices and automatic doors, parking lot/garage barriers and/or elevators and elevator groups linked to them.

The invention claimed is:

1. Method for calling an elevator located inside of a building to a passenger's starting floor, initiated upon the passenger with a predetermined identification, arriving at an exterior door of a building, comprising the steps of:

arriving at an exterior door of the building, the passenger's arrival is detected and identified as a passenger with a predetermined identification by means of a first remote sensing device placed at a first distance from the elevator inside of a building;

generating an elevator call when an outer door or other predetermined doors of the building are opened to serve the passenger with a predetermined identification detected and identified by the first remote sensing device; and confirming the call generated by the first remote sensing device by a detection made by a second remote sensing device located at a second distance from the elevator inside of a building, the said second distance being shorter than the said first distance.

2. Method according to claim 1, further comprising the step of:

cancelling the call generated by the first remote sensing device if the second remote sensing device does not confirm the call within a set period of time.

3. Method according to claim 1 or 2, further comprising the step of:

signaling an elevator call confirmation, based on the passenger with a predetermined identification, with a destination call to the destination floor being automatically input to the elevator control system (E).

4. Method according to claim 1, further comprising the step of:

detecting and identifying the passenger with a predetermined identification by the first remote sensing device, which detection and identification result in an elevator inside of a building being called to the passenger's starting floor.

5. Method according to claim 3, further comprising the step of:

allowing elevator entry by the passenger with a predetermined identification, after the elevator call has been confirmed, within a predetermined amount of time to board the elevator.

6. Method according to claim 3, further comprising the step of:

opening the elevator doors after the lapse of a predetermined amount of time, after the confirmation of the elevator call.

7. Method according to claim 1, further comprising the step of:

detecting by the elevator control system (E) a second passenger with a predetermined identification in the elevator car, in which case the elevator being delayed for a predetermined amount of time to serve the passenger with a predetermined identification detected by the first or second remote sensing device.

8. Call system for calling an elevator inside of a building to a passenger's starting floor, initiated upon an arriving passenger with a predetermined identification, the system comprises:

a first remote sensing device placed at a first distance from the elevator inside of a building for detecting and identifying the arriving passenger with a predetermined identification;

a set of equipment for generating a call for an elevator inside of a building and to open the outer doors or other predetermined doors of the building automatically to serve the passenger with a predetermined identification detected and identified by the first remote sensing device; and at least a second remote sensing device placed at a distance shorter than the first distance from the elevator for confirming the call generated by the first remote sensing device.

9. System according to claim 8, further comprising:

an access control apparatus operational in conjunction with the first remote sensing device, said access control apparatus serving to identify the passenger with a predetermined identification and the access rights allocated to the passenger with a predetermined identification in the building.

10. System according to claims 8 or 9, further comprising:

equipment for the input of destination calls for an elevator inside of a building.

11. System according to claim 8, further comprising:

a passenger's destination call to the elevator control system (E) is entered automatically on the basis of passenger identification from the passenger with a predetermined identification.

12. System according to claim 8, further comprising:

doors and barriers of a parking garage of the building are opened automatically on the basis of the passenger with a predetermined identification detection and identification.

* * * * *